United States Patent [19]

Quakenbush

[11] 4,131,960

[45] Jan. 2, 1979

[54] CONVERTIBLE SEAT-BED

[75] Inventor: Howard M. Quakenbush, Apple River, Ill.

[73] Assignee: Flexsteel Industries, Inc., Dubuque, Iowa

[21] Appl. No.: 828,727

[22] Filed: Aug. 29, 1977

[51] Int. Cl.[2] ..... A47C 17/17

[52] U.S. Cl. ..... 5/37 R; 297/342

[58] Field of Search ..... 5/37 R, 12 R, 13, 47, 5/147; 297/317, 342, 65

[56] References Cited

U.S. PATENT DOCUMENTS

| | | | |
|---|---|---|---|
| 3,887,229 | 6/1975 | Plume | 5/37 R |
| 4,001,901 | 1/1977 | Quakenbush | 5/37 R |
| 4,037,872 | 7/1977 | Quakenbush | 297/65 |

FOREIGN PATENT DOCUMENTS

| | | | |
|---|---|---|---|
| 653375 | 8/1960 | Italy | 5/37 R |

*Primary Examiner*—Kenneth J. Dorner
*Attorney, Agent, or Firm*—Brezina & Lund

[57] ABSTRACT

A convertible seat-bed is provided in which seat and back cushions are attached to frames which are supported from a linkage for movement between a seating condition in which the back cushion extends upwardly and rearwardly from the rear edge of the seat cushion and a bed condition in which body-engaging surfaces of the cushions are in a common horizontal plane. The linkage includes a front swing arm pivotally connected at its upper end to a back frame, a rear swing arm connected at its upper end and to the back frame through a short link and a link between the swing arms extending forwardly to the lower end of another link which is pivotally connected at its upper end to a seat frame and which is connected through a further link to the front swing are. The linkage operates to keep the rear edge of the seat cushion in close proximity to an adjacent edge of the back cushion in both conditions and is located below and behind the seat and back cushions. The front of the seat cushion may be lifted for access to storage space and also to facilitate operation between the seating and bed conditions.

16 Claims, 5 Drawing Figures

CONVERTIBLE SEAT-BED

The invention relates to a seat-bed construction and more particularly to a construction which permits a high degree of efficiency in the utilization of space, as in campers or mobile vehicles, and which is rugged in construction and highly reliable while being comparatively simple and economical with respect to manufacture thereof.

BACKGROUND OF THE PRIOR ART

In my U.S. Pat. No. 3,913,152, issued on Oct. 21, 1975, I disclose a convertible seat-bed unit in which a back is moved from an inclined position downwardly to a position behind the seat, the seat being moved forwardly and the back and the seat then having upper surfaces substantially in a common horizontal plane for use as a bed. As also disclosed, a linkage arrangement is provided for effecting the proper conjoint movement of the seat and the back in a manner such that the top edge portion of the back is moved substantially in a vertical path, which is especially advantageous in camper vehicles or the like in that the supporting frame of the unit can be rigidly secured to the frame of the vehicle.

In my U.S. Pat No. 4,001,901, issued on Jan. 11, 1977, I disclose improvements including the provision of a construction such that operating parts of the mechanism are behind and below the back of the unit, rather than on the outside, and the provision of a pair of units so arranged that when the seats of both units are moved forwardly, the forward edges thereof are brought into a position adjacent each other. In camper-type vehicles, a dinette table may be removably disclosed between the two units.

In my U.S. Pat. No. 4,037,872, issued July 26, 1977, I disclose a linkage arrangement in which operating parts are behind and below the back of the unit, differing from that disclosed in my U.S. Pat. No. 4,001,091 in that a pivotal connection is provided between seat and back support structures and also in that the support of the seat is through swing arms rather than through the use of rollers riding in track as disclosed in U.S. Pat. No. 4,001,901. The construction disclosed in my U.S. Pat. No. 4,037,872 is thereby somewhat simpler and more economical to manufacture than that disclosed in my U.S. Pat. No. 4,001,901. However, it has been found to have one disadvantage in that because of the pivotal connection between the seat and back support structures, it is not possible to secure both of the seat and back cushions to the corresponding support structures and at the same time avoid producing an open space between edges thereof in the bed condition. Because of this, the back cushion in the construction of U.S. Pat. No. 4,037,872 is not secured to the back support structures and is a separate cushion placed by the user in the proper positions for use in both the seat and bed conditions.

There are many prior disclosures by others of linkage arrangements for seat and back support structures but none are believed to be as pertinent as my patents discussed above. The Logan U.S. Pat. No. 3,282,625 issued Nov. 1, 1966 shows a back support supported by two arms or links and a seat support, which is pivotally connected at about its center point to one end of an arm and is also connected through a link to the point of pivotal connection of the back support to one of its supporting arms. This arrangement has disadvantages over the arrangements disclosed in my patents including the fact that the upper end of the back support moves a substantial distance to the rear in moving from the seat condition to the bed condition.

SUMMARY OF THE INVENTION

This invention was evolved with the general object of improving upon the constructions of prior art seat-bed constructions and also of improving upon the construction disclosed in my aforesaid prior applications.

A more specific object of the invention is to provide a construction which utilizes an economically manufacturable linkage arrangement and which will incorporate advantageous features as disclosed in my prior applications including the movement of a top edge portion of a back in a substantially vertical path, the location of operating parts behind and below back and seat portions of a unit, rather than on the outside, and the use of seat and back cushions both securely fastened to support structures with the rearward edge of a seat cushion being in close proximity to one edge of a back cushion in both the seat and bed conditions of the unit.

In accordance with this invention, linkage means are provided including front and rear swing arm means pivotally connected to a base structure on spaced horizontal axes with seat and back support structures being supported from such swing arm means by means including link means. The linkage means are so arranged that all parts thereof are located in both seat and bed conditions on the downward and rearward side of a boundary defined by the seat and back support structures and a plane extending from a rearward edge of the seat support structure to one edge of the back support structure. In the seating condition, one edge of the back support structure is spaced rearwardly and upwardly from the rearward edge of the seat support structure with a first predetermined horizontal spacing therebetween and with a first predetermined vertical spacing therebetween. In the bed conditions, there is a second predetermined horizontal spacing distance between the rearward edge of the seat support structure and the one edge of the back support structure. Such predetermined spacing distances are so related as to position the rearward edge of a cushioned seat and an edge of a cushioned back in close proximity in both the seating and bed conditions of the linkage means, the second predetermined horizontal spacing distance being substantially less than the first predetermined horizontal spacing distance.

This combination has important advantages in that all parts of the linkage means are effectively hidden from view and from possible contact by persons utilizing the assembly in either the seat condition or the bed condition thereof. With the combination of the swing arm means and the link means, only relatively simply and inexpensive arms, links and pivotal connections are involved with respect to manufacture of the unit. In addition, by maintaining the predetermined spacing distances in the relationship set forth above, cushioned seats and backs can be securely fastened to the seat and back support structures, to provide a more secure support of a user in both the seat and bed conditions and to minimize the cost of manufacture of the assembly.

In accordance with specific features of the invention, the back support structure is pivotally connected to an upper end of the front swing arm means on an axis which is close to the edge portion of the back support structure which is adjacent the rearward edge of the seat support structure, the front swing arm means being swung from a rearwardly inclined position to a forwardly inclined position in movement from the seating condition to the bed condition. The back support structure is connected to the upper end of the rear swing arm means through a short link connection while lower connecting link means are provided between intermediate portions of the front and rear swing arm means. Thus an arrangement is provided for supporting the back which is similar to that of my U.S. Pat. No. 4,037,872. However, rather than providing a direct pivotal connection between the seat support structure and the back support structure, the seat support structure is pivotally connected to link means which are connected to the front swing arm means through two additional link means one of which may preferably form an extension of the link means which connects the front and rear swing arm means. With the proper spacing between the axes of pivotal connections, the optimum movements of the seat and back support structures are obtained.

Preferably and in accordance with a further specific feature, the front end of the seat support structure can be lifted when the assembly is in the seating condition so as to pivot about its pivotal connection to the link means and access to the space therebelow is obtained so that such space may be used for storage which is especially advantageous in camper-type vehicles.

Further features include the provision of interengaging stop means on the swing arm and link means for securely supporting both the seat and back support structures in both conditions thereof.

This invention contemplates other objects, features and advantages which will become more fully apparent from the following detailed description taken in conjunction with the accompanying drawings.

Figure 1:
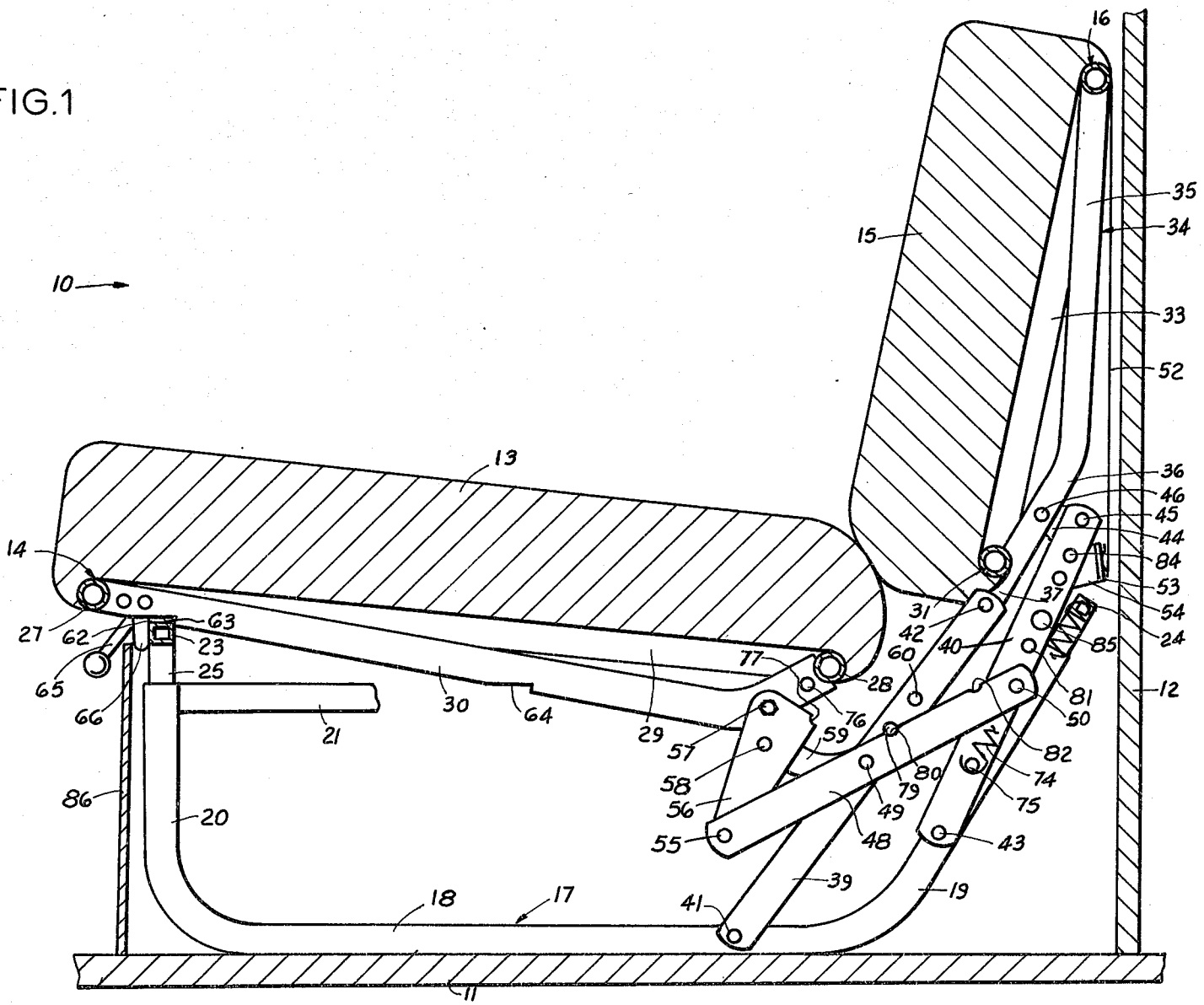
FIG. 1 is an elevational sectional view through a convertible seat-bed unit according to the invention, showing support and linkage structure at one end of the unit when the unit is in a seating condition.

Reference numeral 10 generally designates a seat-bed unit constructed in accordance with the principles of this invention. The unit 10 may be used in a wide variety of applications but was especially designed for use in a camper-type vehicle to be secured to a floor designated by reference numeral 11 and against a vertical wall designated by reference numeral 12. A seat cushion 13 is secured to a seat support frame structure 14 and a back cushion 15 is secured to a back support frame structure 16. In the seating condition illustrated in FIG. 1, the back cushion 15 projects upwardly and slightly rearwardly from a rearward edge portion of the seat cushion 13 while in the bed condition, the back cushion 15 is horizontal with a body-engaging surface thereof in the same horizontal plane as an upper body-engaging surface of the seat cushion 13. For more comfortable seating, the upper body-engaging surface of the seat cushion is preferably inclined downwardly and rearwardly to some extent in the seating condition illustrated in FIG. 1, while being substantially in a horizontal plane in the bed condition of FIG. 2.

A main frame structure is provided including a tubular end member 17 having a horizontal portion 18 adapted to rest against the floor 11, a portion 19 extending angularly upwardly and rearwardly from the rearward end of the portion 18 and a portion 20 extending upwardly from the forward end of the portion 18. A rigidifying bar 21 extends from the upper end of the forward portion 20 to the rearward portion 19. The end member 17 is connected to a similar end member at the opposite end of the unit by a pair of square hollow bars 23 and 24, a fitting 25 at the end of bar 23 being inserted in the upper end of the forward portion 20 of the tubular frame member 17 and being bolted or otherwise secured thereto.

The seat frame structure 14 includes parallel horizontal front and rear tubular members 27 and 28 having ends rigidly secured to and connected by an end bar 29 with an additional bar 30 also extending between the members 27 and 28 on the inside of the bar 29. As shown, bar 30 extends angularly downwardly relative to the end bar 29 to a lowermost point close to the member 28 and thence angularly upwardly to the member 28.

The back frame structure 16 is similar, including parallel tubular members 31 and 32 connected by an end bar 33 with an additional bar 34 also being secured between members 31 and 32 on the inside of the end bar 33. Bar 34 has angularly related portions 35 and 36 and in the position illustrated in FIG. 1, the portion 35 is generally vertical while the portion 36 extends angularly downwardly and forwardly from the lower end of the portion 35. An additional portion 37 extends downwardly and forwardly from the lower end of the portion 36 as an extension thereof.

For supporting the seat and back support frames 14 and 16 and effecting the required movements thereof, a linkage arrangement is provided which includes front and rear swing arms 39 and 40. The lower end of the front swing arm 39 is pivotally connected by a pin 41 to the horizontal portion 18 of the frame member 17 and the upper end thereof is pivotally connected by a pin 42 to the extension 37 of the bar 34 of the back support frame 16.

The rear swing arm 40 has a lower end pivotally connected through a pin 43 to the rear portion 19 of the end main frame member 17. A connection is provided between the upper end of the arm 40 and the back frame structure 16, permitting relative movement thereof. In the illustrated construction, a short link 44 is provided having a rearward end pivotally connected to the upper end of the arm 40 through a bolt 45 and having a forward end pivotally connected to the portion 36 of the bar 34 of the frame 16 through a rod 46. One end of rod 46 is welded or otherwise rigidly secured to link 44 and the other end thereof is similarly rigidly secured to a corresponding link at the opposite end of the unit. Rod 46 serves a timing function, keeping such links at the same angular positions at all times.

An additional link 48 is provided to connect the front and rear swing arms 39 and 40, link 48 being connected to an intermediate point on the front swing arm 39 through a pin 49 and being connected to an intermediate point on the rear swing arm 40 through a pin 50.

Figure 2:
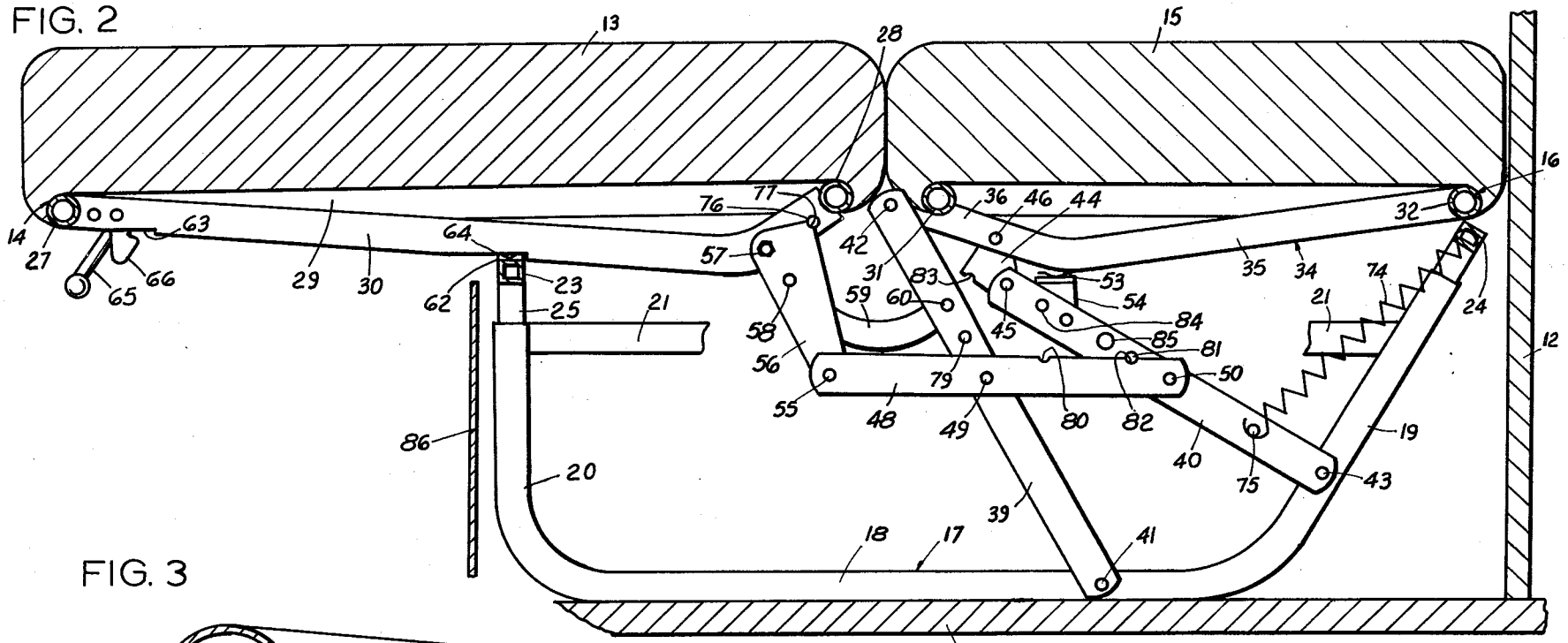
FIG. 2 is a view similar to FIG. 1 but illustrating the parts in a bed condition.

With the arrangement as thus far described, forward movement of the lower portion of the back support frame 16 will result in movement thereof from the seating position of FIG. 1 in which is it inclined upwardly and rearwardly to the bed position of FIG. 2 in which it is generally horizontal. In such movement, the upper end of the back support frame 16 moves in a substantially vertical path without contacting the wall 12 even though disposed in close proximity thereto. It is noted that a back panel 52 of a flexible fabric material or the like may be connected between the member 32 of the back support frame 16 and a bar 53 which is secured at one end to the rear swing arm 40 through a bracket 54, the opposite end of the bar 53 being secured in a similar fashion to a corresponding rear swing arm at the opposite end of the unit.

For support of the seat frame 14, the link 48 is extended forwardly to a forward end which is pivotally connected through a pin 55 to the lower end of a link 56 the upper end of which is pivotally connected through a pin 57 to the bar 30 of the seat support frame 14. At an intermediate point, the link 56 is pivotally connected through a pin 58 to a forward end of a curved link 59 having a rearward end pivotally connected to the front swing arm 39 through a pin 60 at a point intermediate the pins 42 and 49.

In the seating condition, member 31 of the frame 16 is spaced rearwardly and upwardly from member 28 at the rearward end of the seat support frame 14, with there being horizontal and vertical spacing distances, predetermined in accordance with the thicknesses of the cushions 13 and 15. During operation from the seating condition to the bed condition, the pin 50 at the rearward end of the link 48 moves in an arc about the axis of the pin 43, initially upwardly and then downwardly to be at a position in the bed condition which is well below the position occupied in the seating condition, approximately in horizontal alignment with the pin 49 which moves in an arc about the axis of the pin 41 to be at substantially the same elevation in both the seating and bed conditions. As a result, pin 55 at the forward end of the link 48 is moved upwardly a distance approximately equal to the downward distance of movement of the pin 50. Link 56 is thus elevated and it is also carried forwardly and pivoted in a counter-clockwise direction to move the member 28 at the rear end of the frame upwardly and forwardly. The forward component of the movement of member 28 is approximately equal to the forward component of the movement of pin 58 which, in turn, is approximately equal to the forward component of the movement of pin 60. Due in part to the fact that the distance from pin 42 to the pin 41 is greater than the distance from pin 60 to pin 41, the member 31 at the edge of back support frame 16 is moved to a position much closer to the rear end member 28 of the seat support frame 14 than is the case in the seating condition. As a result, the rearward edge portion of the seat cushion 13 and the adjacent edge portion of the back cushion 15 are maintained in contact or at least in close proximity at all times during movement from the seating conditions to the bed condition. The seat and back cushions 13 and 15 may thus be securely secured to the seat and back support frames 14 and 16.

In the seating condition as illustrated in FIG. 1, a bar 62 secured on top of the bar 23 of the frame structure engages in a notch 63 of the bar 30 of the seat support frame 14 and in the bed condition, the bar engages in another notch 64 of the bar 30. Lock means are provided for locking the seat support frame 14 to the main frame in the seating condition. In particular, an operating lever 65 is rigidly secured to a lock member 66 with both being pivotally supported from the bar 30 through a pin 67 and being urged in a counter-clockwise direction as viewed in the drawings, by a tension spring 68 connected between a pin 69 on the lock member 66 and a pin 70 on the bar 30.

The lock member 66 has a notch 71 which receives a projecting portion of the bar 62 in the seating condition of the unit. To release the lock, the operating arm is pulled upwardly and the unit may then be operated from the seating condition to the bed condition.

To so operate the assembly from the seating condition to the bed condition, the forward end of the seat is simply lifted and pulled forwardly to pull the link 56 forwardly and to thereby cause the front and rear swing arms 39 and 40 to swing from the positions illustrated in FIG. 1 to the positions illustrated in FIG. 2, such forward movement being continued until a position of the seat support frame 14 is reached at which the bar 62 can engage in the notch 64 of the bar 30.

To move from the bed condition to the seating condition, the forward end of the seat is lifted and pushed rearwardly to cause a reverse movement of the elements of the linkage mechanism. Two important features are provided for assisting the operation from the bed condition to the seating condition and to minimize the required forces. First, a coiled tension spring 74 is provided between the rear bar 24 of the main frame and a pin 75 located on the rear swing arm 40 between the pins 43 and 50. Secondly, a pin 76 is provided on the bar 30 of the seat support frame 14 which is engagable in a notch 77 formed on the link 56. When the assembly is in the bed condition as illustrated in FIG. 2, and when the forward end of the seat is lifted, the pin 76 moves about the axis of the pin 57, engaging in the notch 77 of the link 56 to create angular couple forces which assist the action of the spring 74 in effecting a movement toward the seating condition. Accordingly, the unit is readily operated from the bed condition to the seating condition. To some extent, especially with regard to the action of the spring 74, the forces applied are such as to resist operation from the seating condition to the bed condition. However, the nature of the linkage arrangement is such that the problems are not great in this respect, and the mechanism can be also readily operated from the seating conditions to the bed condition.

Interengaging stop means are provided for providing firm support of the seat and back support structures in both the seating and bed conditions. A pin 79 is provided on the front swing arm 39 which engages in a notch 80 of the link 48 in the seating condition as illustrated in FIG. 1 and a pin 81 is provided on the rear swing arm 40 which engages in a notch 82 of the link 48 in the bed condition as illustrated in FIG. 2. The link 44 is formed with a notch 83, shown in FIG. 2, which engages a pin 84 on the rear swing arm 40 when the unit is in the bed condition of FIG. 1. The rearward end of the back support frame 16 may rest on the bar 24 of the main support frame in the bed condition.

It is noted that the engagement of notch 83 of the link 44 by the pin 84 resists rotation of the link especially when the unit is tested by applying a rearward force to the top of the back. Also, a stop pin 85 is provided for engaging the portion 19 of the frame member 17 to resist rearward movement of the rear swing arm 40.

The front edge portion of the seat may be lifted when the unit is in the seating condition (after release of the lock) for access to the space below the seat which provides a convenient storage space, especially for camper vehicles or the like. A forward panel 86 may be provided which encloses the space and which is affixed to the floor 11 to enclose the storage space, the panel 86 being cleared when the unit is operated between its two conditions.

It is noted that the seat cushion 13 and back cushion 15 may be securely and permanently attached to the frames 14 and 16 and may include suitable springs as well as padding material and upholstering or covering material. The linkage means is hidden below and behind the seat and back cushions, out of possible contact by the user, being below and behind an imaginary boundary surface defined by the seat and back frames 14 and 16 and a plane extending from member 28 at the rearward end of frame 14 to member 31 of the back frame 16. The front and rear swing arms and the links are readily and economically formed from plate or bar stock and the pivotal connections are readily provided. Preferably, rivet pins may be used for the pins 41, 43, 49, 50, 55, 58 and 60 and the various stop pins may be installed with drive fits. Bolts may be used to form the pins 42, 45 and 57 for installation of the seat and back frames after assembly of the linkages.

Figure 5:
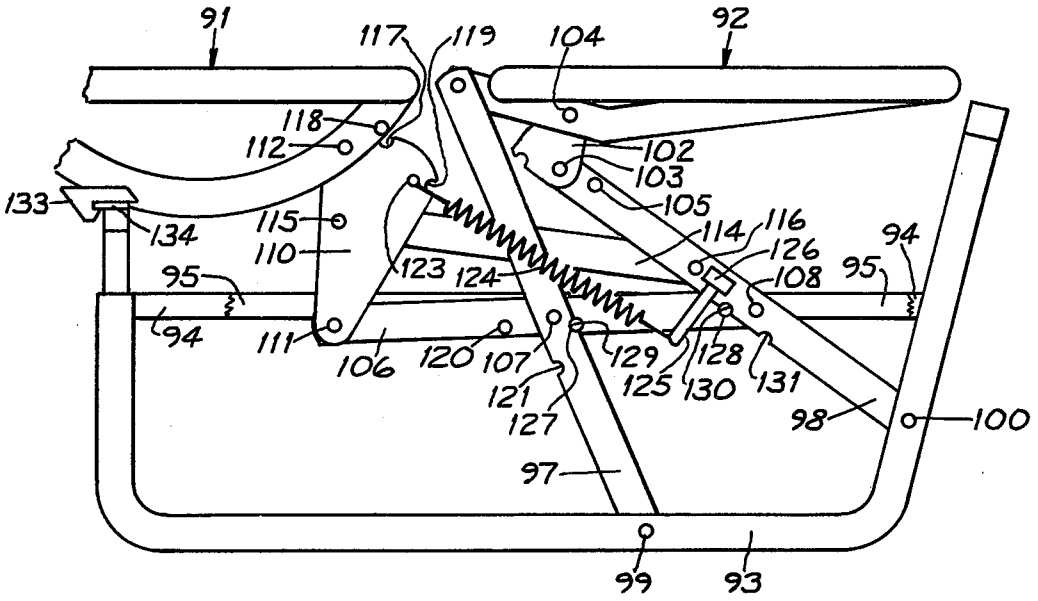
FIG. 5 is a view similar to FIG. 4 but showing the unit in a bed condition.
Figure 4:
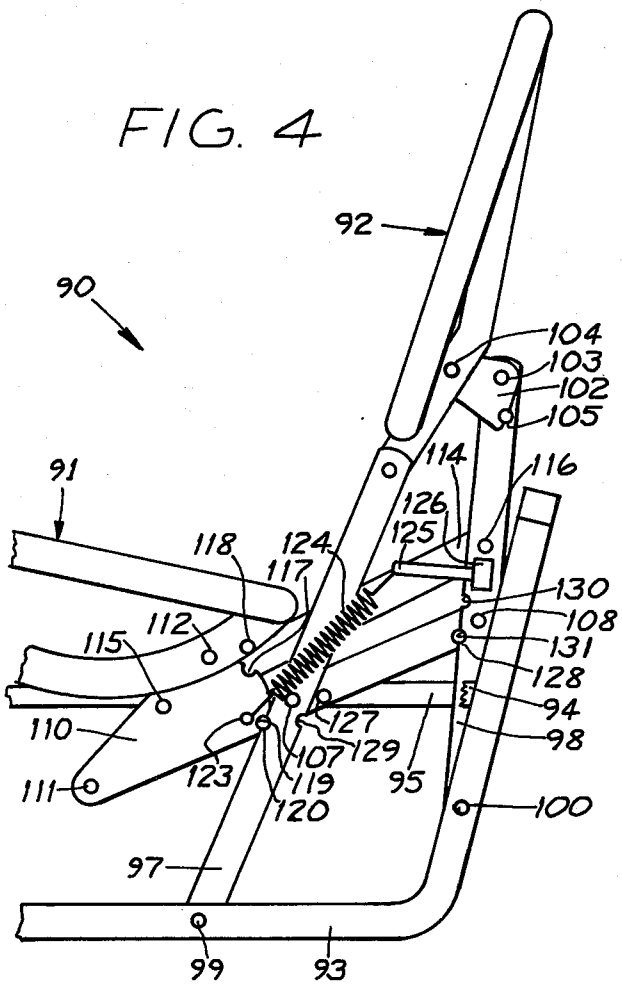
FIG. 4 is a side elevational view showing a linkage assembly and parts of seat, back and frame structures of a unit having a modified construction, the unit being shown in a seating conditions.

Referring to FIGS. 4 and 5, reference numeral 90 generally designates a seat-bed unit having a modified construction and including a seat support frame structure 91, a back support frame structure 92 and a main frame structure including a tubular end member 93 and a horizontal rigidifying bar 94 part of which is shown broken away with part of a similar bar 95 at the opposite end of the unit being visible. The seat and back frame structures 91 and 92 are similar to those of the unit 10 and it will be understood that seat and back cushions, not shown, are securely attached thereto.

The unit 90 further includes a linkage which in many ways in very similar to that of the unit 10 and includes front and rear swing arms 97 and 98 pivotally connected to the frame member 93 by pins 99 and 100. A link 102 is provided having one end pivotally connected to the upper end of the rear swing arm 98 through a pin 103, having an opposite end pivotally connected to the back support frame structure through a rod 104 and having a notch engagable by a pin 105 on the arm 98 in the seating condition of FIG. 4. Rod 104 is rigidly secured to the link 102 and to a corresponding link at the opposite end of the unit 90.

A link 106 is connected to the front and rear swing arms through pins 107 and 108 and a link 110 is pivotally connected to the forward end of link 106 and to the seat support frame 91 through pins 111 and 112, such links 106 and 110 being similar in configuration and in operation to the links 48 and 56 of the unit 10. An additional link 114 is provided having a forward end connected to the link 110 through a pin 115 and having a rearward end pivotally connected to the rear swing arm 98 through a pin 116. This arrangement provides a more positive action than is the case in the unit 10 wherein the rearward end of link 59 is pivotally connected to the front swing arm.

The link 110 is similar to the link 56 of unit 10 and has a notch 117 similar to notch 77 and engageable by a pin 118 on the seat frame structure 91. Link 110 differs from link 57 in having a section added to provide a notch 119 engageable by a pin 120 on the link 106 in the seating condition of FIG. 4. At the same time, pin 120 also engages in a notch 121 in the front swing arm 97, This arrangement improves rigidity, especially in regard to limiting oscillatory forward and backward movement of the top of the back.

Link 110 also carries a pin 123 which is connected to one end of a coiled tension spring 124 the opposite end of which is connected to the end of an arm 125 carried by a member 126 which is secured to the rear swing arm 98 at a position between pins 108 and 116. With the spring 124 acting between points of the linkage as shown, it functions to assist in opening and/or closing, i.e. in effecting movement to the seating condition and/or the bed condition, the action of the spring being reversed when the linkage goes through a position which is intermediate the seating and bed conditions. Preferably, arm 125 is in the form of a screw which is threaded through member 126 and which is thereby adjustable to position the end of arm 125 at the optimum position.

To provide increased rigidity and strength, pins 127 and 128 on link 106 are engagable in notches 129 and 130 on the front and rear swing arms 97 and 98 in the bed condition with pin 128 being engagable with notch 131 on the rear swing arm 98 in the seating condition.

Figure 3:
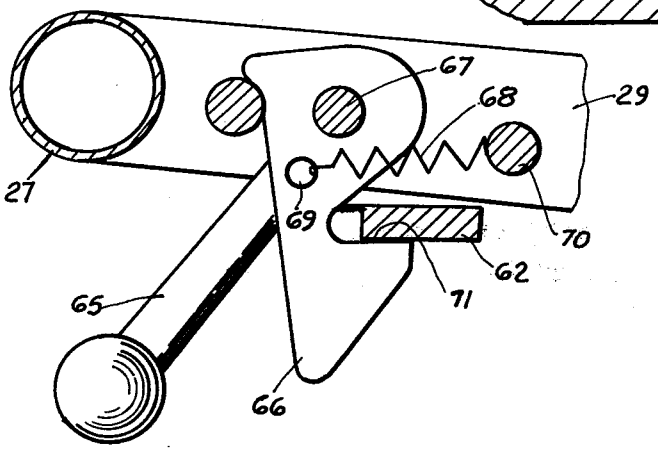
FIG. 3 is a view on an enlarged scale, showing details of a lock assembly.

To more securely lock the unit in the bed condition, a lock bar 133 is welded or otherwise secured to the seat frame structure 91 to engage a projecting portion of a bar 134 on the main frame structure. Bar 134 corresponds to bar 62 of the unit 10 and a locking arrangement similar to that of the unit 10 as shown in FIG. 3 is provided for locking in the seating condition.

It will be understood that modifications and variations may be made without departing from the spirit and scope of the novel concepts of this invention.

I claim as my invention:

1. In a convertible seat-bed assembly, a base structure, a seat support structure for support of a generally rectangular seat cushion secured thereto, a back support structure for support of a generally rectangular back cushion secured thereto, and linkage means for supporting said seat and back support structures from said base structure for movement between a seating condition and a bed condition, said seat support structure in said seating condition being in a first position and in said bed condition being in a second position spaced forwardly from said first position, said back support structure in said seating condition being inclined rearwardly and upwardly from a first edge thereof to a second edge thereof with said first edge being spaced rearwardly and upwardly from a rearwardly edge of said seat support structure to provide a first predeterimined horizontal spacing distance therebetween and a first predetermined vertical spacing distance therebetween, said back support structure in said bed condition being generally horizontal with said first and second edges thereof in generally horizontal alignment and with said first edge thereof being spaced rearwardly from said rearward edge of said seat support structure through a second predetermined horizontal spacing distance, said predetermined spacing distances being so related as to position the rearward edge portion of a seat cushion on said seat support structure an an edge of a back cushion on said back support structure in close proximity in both said seating and bed conditions of said linkage means with said second predetermined horizontal spacing distance being substantially less than said first predetermined horizontal spacing distance, said linkage means including front and rear swing arm means having lower ends pivotally connected to said base structure on spaced horizontal axes, and means supporting both of said seat and back support structures from said front and rear swing arm means, all portions of said linkage means being located in both said seating and bed conditions on the downward and rearward side of a boundary defined by said seat and back support structures and a plane extending from said rearward edge of said seat support structure and said one edge of said back support structure, said linkage means including means providing a pivotal connection between an upper end portion of said front swing arm means and said back support structure adjacent said one edge thereof, said linkage means including first link means pivotally connected to said front and rear swing arm means at intermediate points thereof.

2. In an assembly as defined in claim 1, said linkage means further including second link means pivotally connected to said first link means at a point spaced forwardly from the point of pivotal connection of said first link means to said front swing arm means, third link means above said first link means and pivotally connected at opposite ends to said second link means and to one of said swing arm means, and means providing a pivotal connection between an upper end portion of said second link means and a rearward portion of said seat support structure.

3. In an assembly as defined in claim 2, said link means including fourth link means pivotally connected between an upper end portion of said rear swing arm means and said back support structure.

4. In an assembly as defined in claim 2, said seat support structure being pivotal about the axis of the pivotal connection thereof to said second link means for upward movement of the forward end of said seat support structure.

5. In an assembly as defined in claim 4, interengagable stop means on said seat support structure and said second link means arranged to engage in said bed condition when the forward end of said seat support structure is moved upwardly and to cause said second link means to move with said seat support structure during an initial portion of rearward movement of said seat support structure and to assist actuation of said linkage means to said seating condition.

6. In an assembly as defined in claim 5, spring means acting between said base structure and said linkage means to further assist actuation of said linkage means from said bed condition to said seating condition.

7. In an assembly as defined in claim 2, said third link means being pivotally connected to said front swing arm means.

8. In an assembly as defined in claim 2, said third link means being pivotally connected to said rear swing arm means.

9. In an assembly as defined in claim 1, said linkage means including interengagable stop means to limit movement beyond said seating and bed conditions and for support of said seat and back support structures in both said seating and bed conditions.

10. In an assembly as defined in claim 1, seat and back cushions securely attached to said seat and back support structures.

11. In an assembly as defined in claim 1, interengagable stop means on said rear swing arm means and said first link means to limit movement beyond said seating and bed conditions.

12. In an assembly as defined in claim 2, interengagable stop means between said first link means and said second link means for limiting movement beyond said seating condition.

13. In an assembly as defined in claim 14, said interengagable stop means being also effective between said first link means and said front swing arm means.

14. In an assembly as defined in claim 2, spring means acting between said second link means and said rear swing arm means to assist actuation of said linkage means from each of said seating and bed conditions to the other.

15. In an assembly as defined in claim 1, releasable lock means for locking said seat support structure in said bed condition.

16. In an assembly as defined in claim 15 additional releasable lock means for locking said seat support structure in said seating condition.

* * * * *